US007147343B2

(12) United States Patent
Chapman

(10) Patent No.: US 7,147,343 B2
(45) Date of Patent: Dec. 12, 2006

(54) FLASHLIGHT

(75) Inventor: Leonard T. Chapman, North Hollywood, CA (US)

(73) Assignee: Chapman/Leonard Studio Equipment, North Hollywood, CA (US)

( * ) Notice: Subject to any disclaimer, the term of this patent is extended or adjusted under 35 U.S.C. 154(b) by 130 days.

(21) Appl. No.: 10/397,766

(22) Filed: Mar. 25, 2003

(65) Prior Publication Data

US 2004/0190299 A1 Sep. 30, 2004

(51) Int. Cl.
*F21V 4/04* (2006.01)

(52) U.S. Cl. ..... 362/187; 362/188; 362/250; 362/800

(58) Field of Classification Search ..... 362/394, 362/167, 169, 170, 174, 178, 187, 188, 196, 362/197, 199, 202, 227, 240, 250, 372, 326, 362/332, 334, 269, 277, 285, 800
See application file for complete search history.

(56) References Cited

U.S. PATENT DOCUMENTS

| | | | | |
|---|---|---|---|---|
| 1,478,282 | A | 12/1923 | Hunter | |
| 1,591,627 | A | 7/1926 | Hopkins | |
| 1,595,146 | A | 8/1926 | Ford | |
| 1,603,272 | A | 10/1926 | Eaton | |
| 2,215,900 | A * | 9/1940 | Bitner | 362/309 |
| 2,249,689 | A | 7/1941 | Gelardin | |
| 2,313,356 | A | 3/1943 | New | |
| 2,347,532 | A | 4/1944 | Yardeny | |
| 2,435,689 | A | 2/1948 | McCabe | |
| 3,535,282 | A | 10/1970 | Mallory | |
| 3,800,136 | A | 3/1974 | Edelson | |
| 4,577,263 | A | 3/1986 | Maglica | |
| 4,605,994 | A | 8/1986 | Krieg | |
| 4,623,957 | A | 11/1986 | Moore et al. | |
| 4,875,147 | A | 10/1989 | Auer | |
| 4,947,291 | A | 8/1990 | McDermott | |
| 5,138,538 | A | 8/1992 | Sperling | |
| 5,351,330 | A * | 9/1994 | Jongewaard | 385/93 |
| 5,422,798 | A | 6/1995 | Osiecki et al. | |
| 5,594,433 | A | 1/1997 | Terlep | |
| 5,630,661 | A | 5/1997 | Fox | |
| 5,838,024 | A | 11/1998 | Masuda et al. | |
| 5,865,529 | A | 2/1999 | Yan | |
| 6,007,218 | A | 12/1999 | German et al. | |

(Continued)

FOREIGN PATENT DOCUMENTS

| | | |
|---|---|---|
| GB | 2216998 | 10/1989 |

OTHER PUBLICATIONS

Combined International Search Report and Written Opinion of the International Searching Authority for International Application No. PCT/US2004/08472, dated Sep. 23, 2005.

(Continued)

*Primary Examiner*—Sandra O'Shea
*Assistant Examiner*—Guiyoung Lee
(74) *Attorney, Agent, or Firm*—Perkins Coie LLP

(57) ABSTRACT

A flashlight has a lens moveable relative to an LED. The beam of light provided by the LED can be focused and provides a uniform light pattern across the range of focus. The lens is supported on a front housing section and the LED is supported on a back housing section threaded onto the front housing section. Twisting the front housing section closes a switch providing power to the LED, to turn the flashlight on. Twisting the front housing section also adjusts the focus of the beam. A timer circuit within the flashlight turns the flashlight off after a selected time interval, to preserve battery life.

7 Claims, 11 Drawing Sheets

U.S. PATENT DOCUMENTS

| | | | | |
|---|---|---|---|---|
| 6,013,985 | A | 1/2000 | Green et al. | |
| 6,086,220 | A | 7/2000 | Lash et al. | |
| 6,095,661 | A | 8/2000 | Lebens et al. | |
| 6,142,650 | A | 11/2000 | Brown et al. | |
| 6,220,719 | B1 * | 4/2001 | Vetorino et al. | 362/192 |
| 6,249,089 | B1 | 6/2001 | Bruwer | |
| 6,296,367 | B1 | 10/2001 | Parsons et al. | |
| 6,345,464 | B1 | 2/2002 | Kim et al. | |
| 6,394,630 | B1 | 5/2002 | Skidmore et al. | |
| 6,398,383 | B1 * | 6/2002 | Huang | 362/202 |
| 6,485,160 | B1 | 11/2002 | Sommers et al. | |
| RE38,014 | E * | 3/2003 | Bieberstein | 362/206 |
| 6,527,419 | B1 * | 3/2003 | Galli | 362/308 |
| 6,612,714 | B1 | 9/2003 | Morre et al. | |
| 6,642,667 | B1 | 11/2003 | Avis | |
| 6,736,531 | B1 | 5/2004 | Wallach | |
| 6,761,467 | B1 | 7/2004 | Matthews et al. | |
| 6,793,366 | B1 | 9/2004 | Chun | |
| 6,841,941 | B1 | 1/2005 | Kim et al. | |
| 6,854,859 | B1 | 2/2005 | Cooper et al. | |
| 6,866,401 | B1 * | 3/2005 | Sommers et al. | 362/268 |
| 6,957,897 | B1 | 10/2005 | Nelson | |
| 2002/0067608 | A1 | 6/2002 | Kruse et al. | |
| 2002/0093818 | A1 | 7/2002 | Mele | |
| 2002/0149930 | A1 | 10/2002 | Parker | |
| 2003/0123254 | A1 * | 7/2003 | Brass et al. | 362/231 |
| 2004/0130892 | A1 | 7/2004 | Galli | |
| 2004/0140771 | A1 | 7/2004 | Kim et al. | |
| 2004/0240201 | A1 * | 12/2004 | Rausseck | 362/171 |
| 2005/0122714 | A1 | 6/2005 | Matthews et al. | |
| 2005/0157492 | A1 | 7/2005 | Chui | |

OTHER PUBLICATIONS

Combined International Search Report and Written Opinion of the International Searching Authority for International Application No. PCT/US2005/28831, dated Mar. 14, 2006.

Mag-lite Brochure: Anatomy-Mini Maglite. (Jan. 1, 2001).

AvShop Brochure: LED Flashlight with Magnifier Lens. Web Archive.org (May 25, 2002).

* cited by examiner 106
20
84
104
73
72
16
54
130
28
48
42
38
34
14
30
32
40
12
46
64
154,254
56
50
36
S
44
60
70
90
82
76
74
78
22
96
93
92
98
108
94
109
18

FLASHLIGHT

BACKGROUND OF THE INVENTION

The field of the invention is flashlights. More specifically, the invention relates to a portable hand held battery powered flashlight. For many years, flashlights have used batteries, specifically, dry cells, to power an incandescent bulb. Reflectors around or behind the bulb have been provided to help direct light from the bulb. More recently, with the development of light emitting diodes (LED's), in some flashlights the incandescent bulb has been replaced by an LED. Use of an LED in place of an incandescent bulb as a light source in a flashlight has several advantages. Initially, LED's use less power than incandescent bulbs. As a result, battery life in an LED flashlights can be greatly extended. In addition, LED's are manufactured with specific light emission directivity. Unlike an incandescent bulb, which radiates light in all directions, LED's emit light in specific directions, or within a specific angle. Accordingly, for spot illumination, which is the most common use for flashlights, the directivity of LED's is advantageous. LED's also have an operating life which is far longer than that of most incandescent bulbs. Consequently, the disadvantages of bulb burnout or failure, and the need to replace bulbs relatively frequently, are largely avoided.

While use of LED's in flashlights have several advantages, design challenges remain. In particular, the ability to achieve a uniform beam of light under a wide range of conditions has yet to be achieved with existing flashlights, regardless of whether the light source is an LED, an incandescent bulb or another light source. The directivity (included angle) of existing LEDs is not sufficiently narrow for lighting distant from the flashlight. Even with the most directional LEDs, having a directivity angle of about 15°, the emitted light becomes very faint more than a few feet away from the LED. For various reasons, the light beam of virtually all flashlights is not uniform. The intensity of light in the beam varies. Generally, this variation appears as lighter and darker areas of the beam. Some flashlights produce a beam having an irregular shape, and decreased lighting efficiency, rather than a nearly perfect circle of uniform light.

In the past, several flashlights, especially flashlights having incandescent bulbs, have included beam focusing features. In these types of flashlights, typically a reflector behind or surrounding the bulb is moved relative to the bulb, to change the light beam pattern or to focus the beam. While beam focusing is a useful feature in these types of flashlights, generally, the shape or uniformity of the beam changes as the beam is focused. These types of flashlights are unable to maintain uniform light beam quality over an entire range of focus. As a result, the light beam typically has dark spots and appears dimmer, and the quality of the light beam, in terms of field of illumination, is degraded.

Another drawback with battery powered flashlights is of course the limited life of batteries. While use of LED's can greatly extend battery life, the traditional drawbacks associated with batteries have not been fully overcome. Even with LED flashlights, prolonged use will drain the batteries. Most flashlights have an on/off switch as the only control. Accordingly, if the switch is inadvertently left on, the batteries will be drained. Thus, to maintain the flashlight in a useable condition, the user must remember to turn the flashlight off. While seemingly a simple step, it is often overlooked, especially where the flashlight is carried from a dark location into a bright location, where there are extensive distractions to the user, or where the flashlight is used by young children. To overcome this disadvantage, various flashlights having automatic shut off features have been proposed. However, few, if any of these proposals have found widespread success, either due to design, operation, manufacturing, cost and/or other reasons. In certain uses or circumstances, it is important that the automatic shut off feature be turned off entirely, so that the flashlight is switched on or off manually. This added requirement provides an additional engineering challenge in flashlight design.

Flashlights have been adapted for use in extreme environments. For example, diving or underwater flashlights have been designed to operate in an undersea environment of high water pressure, low temperature, corrosive seawater, etc. While these types of environmental flashlights have met with varying degrees of success, engineering challenges remain in providing a flashlight which can reliably withstand extreme pressures, high and low temperatures, corrosive environment, shock, vibration and other adverse environmental conditions.

Accordingly, it is an object of the invention to provide an improved flashlight.

SUMMARY OF THE INVENTION

In a first aspect, a flashlight has an aspheric, plano convex, or other suitable lens for focusing light from an LED powered by batteries. As the LED has low power consumption useful battery life in the flashlight is greatly extended. The lens helps to provide a uniform and bright light beam, without the need for a reflector.

In a second aspect, the lens is moveable relative to the LED, allowing the beam to be focused. Preferably, the flashlight housing has a front section supporting the lens, and a rear section supporting the LED. With the rear section advantageously threaded into the front section, turning or twisting the front section focuses the light beam.

In a third and separate aspect, a flashlight has an electronic timer circuit which automatically turns the flashlight off after a preset interval. As a result, battery power is preserved, even if the flashlight is inadvertently left on. Preferably, the preset interval can be adjusted for a short period of time, such as 5–7 minutes, or for a longer period of time, for example, 15 or 20 minutes. For specialized requirements, the timer can be designed to turn off the flashlight after a preselected interval, or the timer can be disabled to provide continuous operation (until manually turned off). The timer circuit is advantageously combined with an LED as the light source in the flashlight.

In a fourth and separate aspect, a flashlight has multiple lens on a lens base aligned with multiple LED's or lamps. Turning a first section of the flashlight causes the lenses to move towards or away from the LED's, to focus the light, with the lenses remaining axially or optically aligned with the LED's. This design allows a flashlight having multiple LED's to focus the light provided by the LED's.

Other further objects and advantages will appear from the following written description taken with the drawings, which show two embodiments. However, the drawings and written description are intended as preferred examples, and not as limitations on the scope of the invention. The invention resides as well as sub combinations of the elements described.

BRIEF DESCRIPTION OF THE DRAWINGS

In the drawings, wherein the same element number indicates the same element in each of the views.

DETAILED OF DESCRIPTION OF THE DRAWINGS

Figure 1:
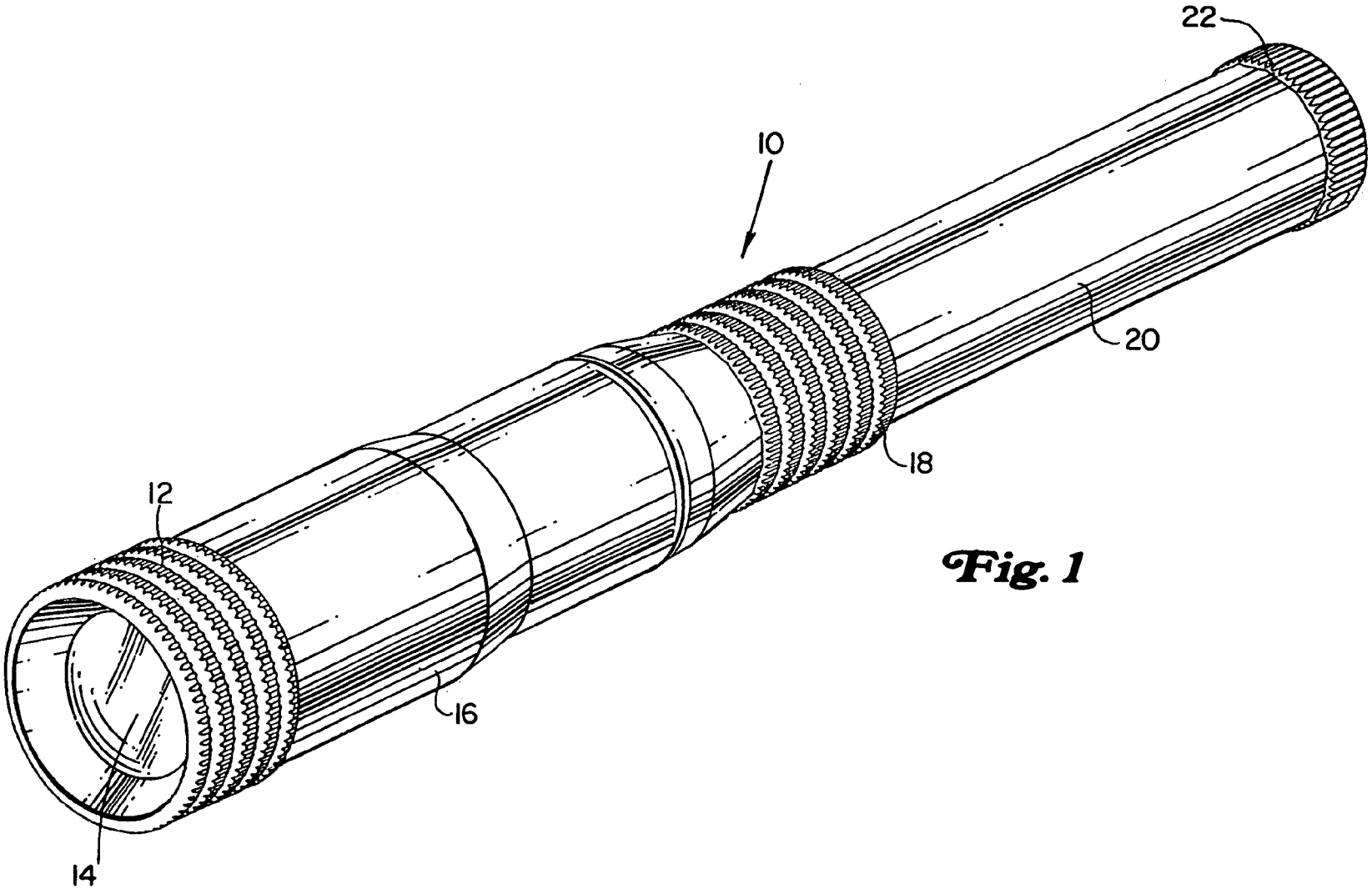
FIG. 1 is a front and side perspective view of the present flashlight.
Figure 2:
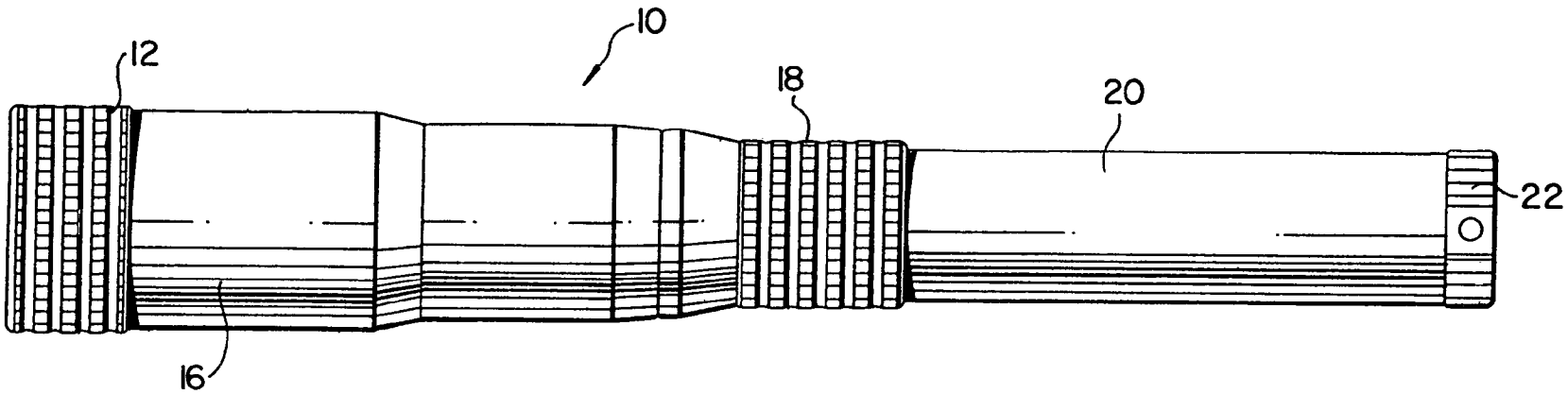
FIG. 2 is a side view of the flashlight shown in FIG. 1.

Turning now in detail to the drawings, as shown in FIGS. 1 and 2 a flashlight 10 has a lens 14 within a front cap 12 on a front housing section 16. A rear housing section 20 extends into the front housing section 16. A housing ring 18 is provided on the rear housing section 20 adjacent to the front housing section 16. And end cap 22 on the rear housing section 20 is removable to install or remove batteries from the flashlight 10.

Figure 3:
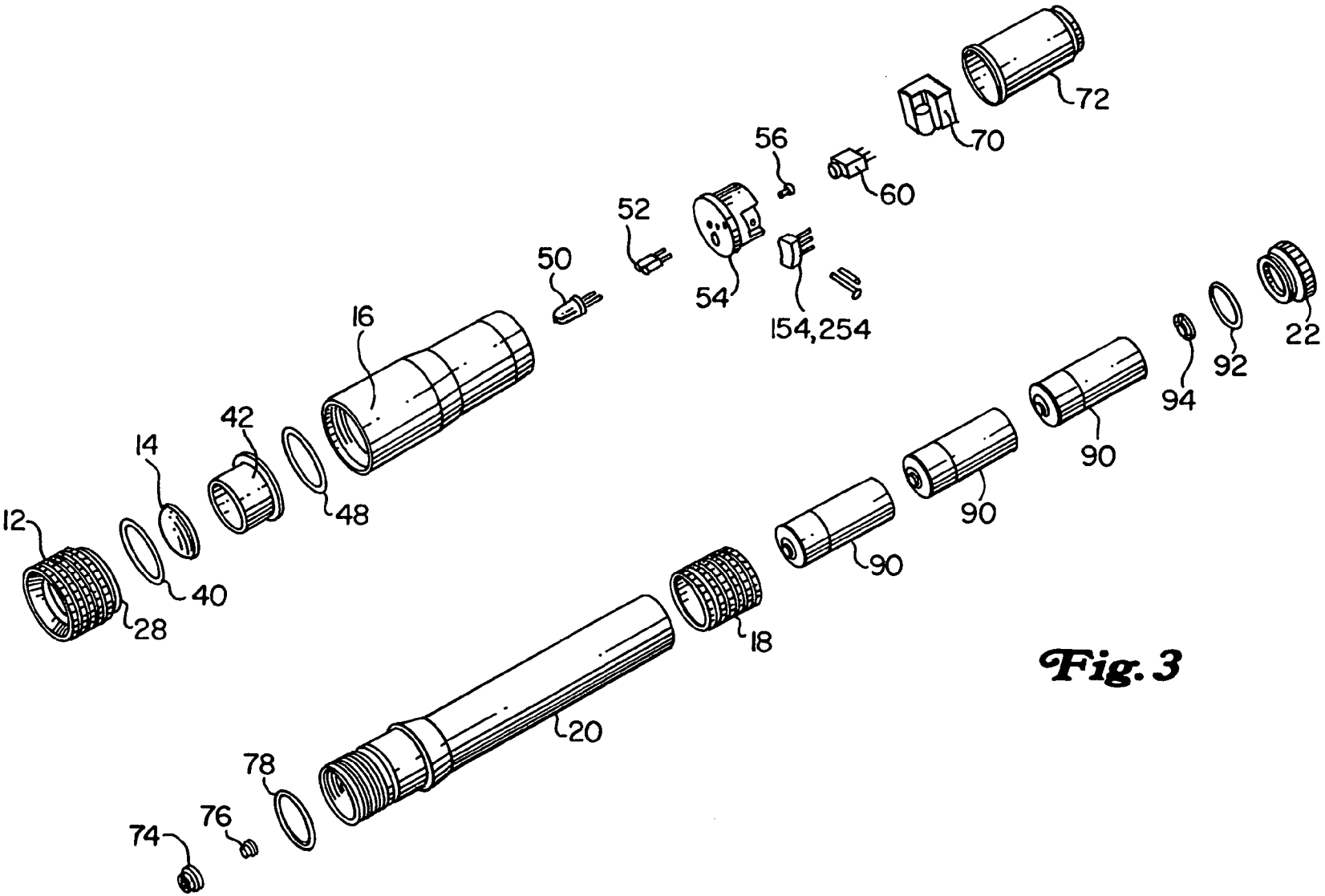
FIG. 3 is an exploded front and side perspective view of the flashlight shown in FIG. 1.
Figure 4:
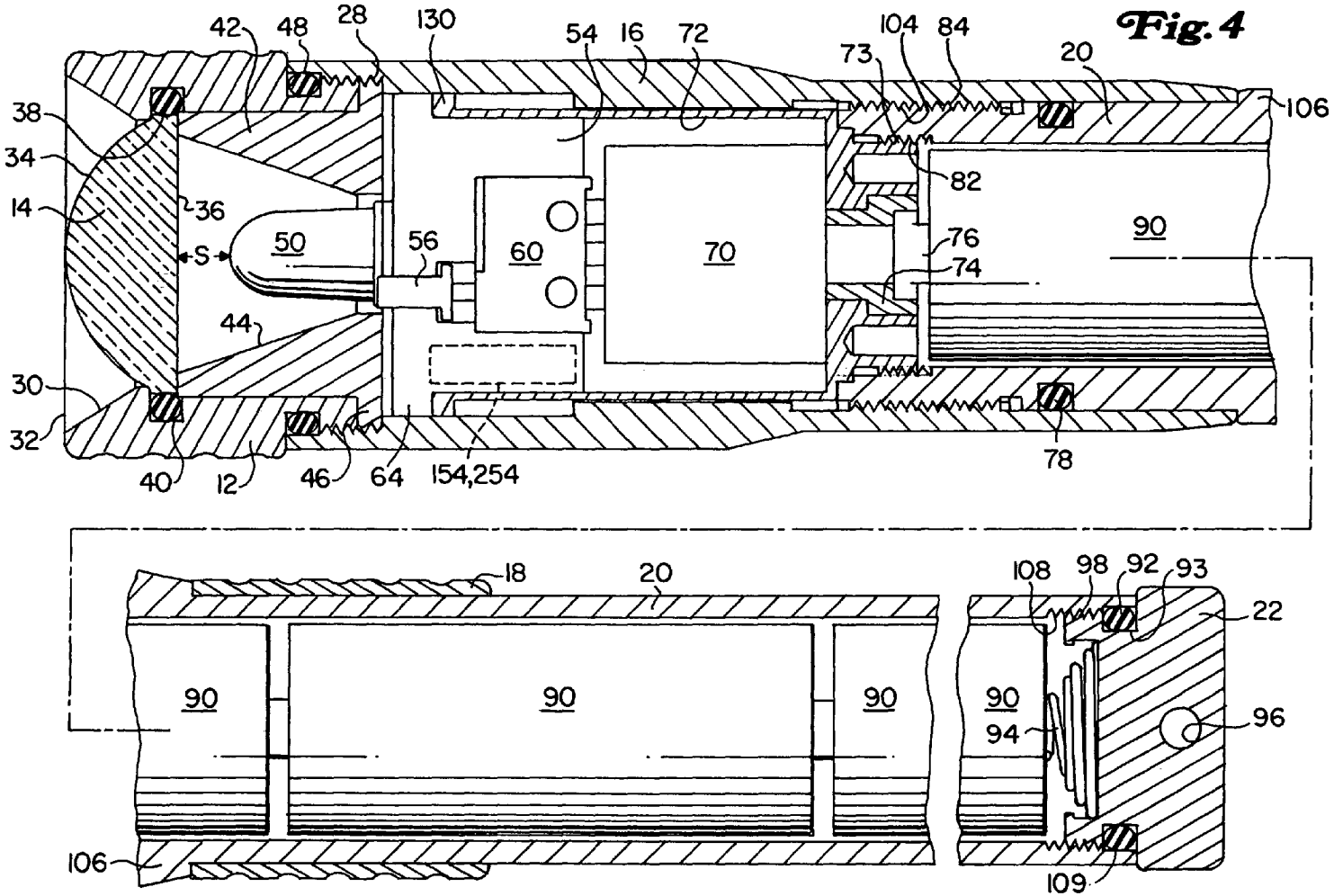
FIG. 4 is an enlarged section view of the flashlight shown in FIG. 1.
Figure 5:
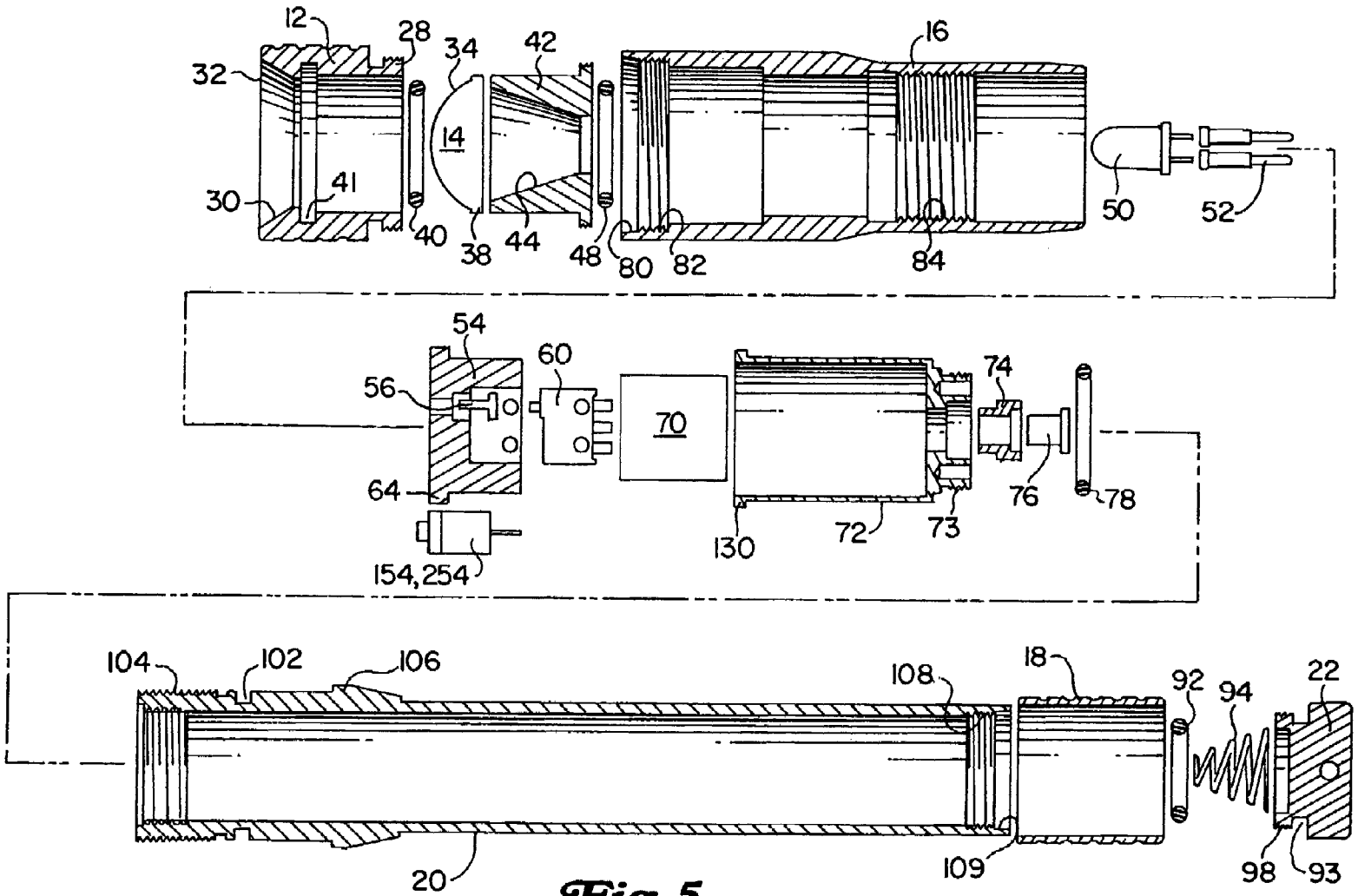
FIG. 5 is an enlarged exploded section view of the flashlight shown in FIGS. 1 and 4.
Figure 7:
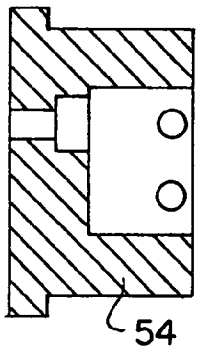
FIG. 7 is a section view taken along line 7—7 of FIG. 6.

Referring now to FIGS. 3, 4 and 5, the front cap 12 has a conical surface 30 at its front end 32. A seal groove 41 is provided adjacent to the conical surface 30 on the front cap 12 as shown in FIG. 5. Screw threads 28 are provided on the back end of the cap 12.

Referring to FIGS. 4 and 5, the lens 14 is preferably an aspheric glass, plano convex, or other suitable (depending on LED selection and focal length) lens. The lens 14 has a spherical front surface 34, and preferably a flat rear surface 36 facing the LED 50. A cylindrical or ring surface 38 at the back end of the lens 14 seals against a seal element, such as an O-ring 40 in the seal groove 41 as shown in FIG. 5. The lens 14 preferably has a focal length of 8–16, 10–14 or 12 mm. The lens is sufficiently thick enough to provide adequate strength to resist pressure equivalent to 9000 feet of water. The center thickness is typically 5–6 millimeters. The term "lens" means an element that focuses or bends light.

Referring to FIGS. 4 and 5, a lamp housing 42 having a conical inside wall 44 is placed or pressed into the front cap 12, holding the lens 14 and O-ring 40 in place. The threaded back end 28 of the front cap 12 is threaded into internal screw threads 82 at the front end of the front housing 16. The lamp housing 42 is longitudinally positioned within the front cap 12 via a flange 46 at the back end of the lamp housing 42 stopping on the back end of the front cap 12. A front cap O-ring or seal 48 seals the front cap 12 to the front housing 16.

The front housing 16 is threaded onto the rear housing 20 via internal threads 84 on the front housing 16 engaged with external threads 104 at the front end of the rear housing 20. The components described above (i.e., the front cap 12, lens 14, O-ring 40, lamp housing 42, and O-ring 48) are all supported on (directly or indirectly) and move with, the front housing 16.

Figure 8:
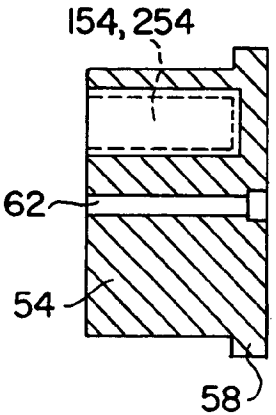
FIG. 8 is a section view taken along line 8—8 of FIG. 6.
Figure 10:
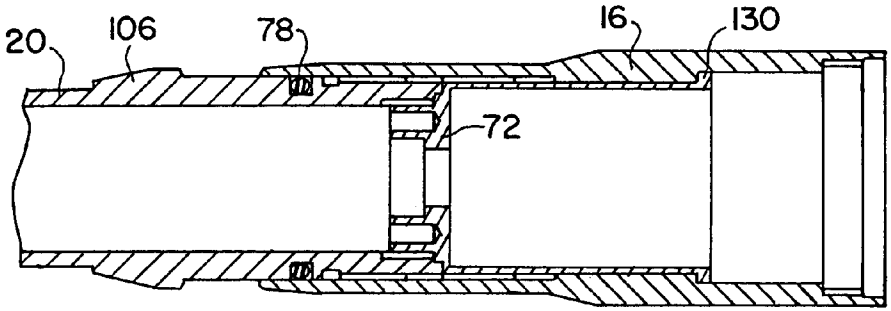
FIG. 10 is a section view of the flashlight shown in FIGS. 1–5, with the front housing section in a fully extended position.
Figure 11:
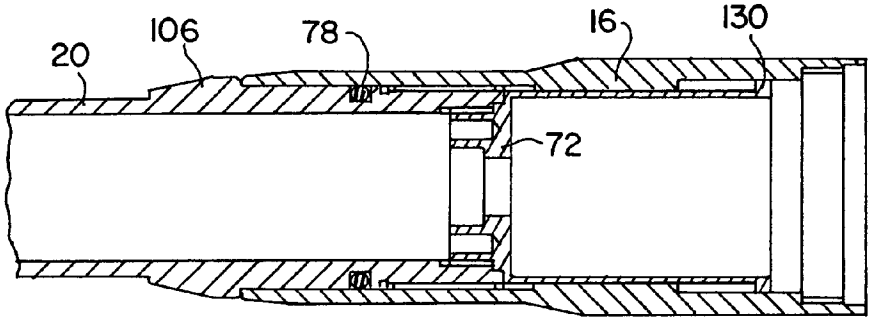
FIG. 11 is a section view showing the flashlight in a fully retracted or off position.

Referring still to FIGS. 4 and 5, the LED, light source or lamp 50 has anode and cathode leads extending into electrical contacts 52 in a switch housing 54. A microswitch 60 is supported within the switch housing 54. A plunger 56 extends from the microswitch 60 through and out of the front end of the switch housing 54, with the plunger biased outwardly against the back surface of the housing 42. The switch housing 54 is supported on or in the front end of a switch housing tube 72. A rim or collar 64 contacts the front end of the switch housing. The contacts 52 extend through contact bores or openings 62 in the switch housing 54, as shown in FIG. 8.

A circuitry module 70 within the switch housing tube 72 is electrically connected to the switch 60, and also to the batteries 90 via a battery contact 76 extending through a tube collar 74 at the back end of the switch housing tube 72. As shown in FIG. 4, a housing seal 78 seals the front end of the rear housing section 20 to the back end of the front housing section 16, while still allowing the front housing section 16 to turn, and shift longitudinally (along a center axis of the flashlight), as the front and rear housing sections are turned relative to each other.

The rear housing section 20 has an open internal cylindrical space for holding the batteries 90. In the embodiment shown in FIGS. 4 and 5, three N size batteries are used. Of course, different numbers and types of batteries may be used, consistent with the requirements of the LED 50 and circuitry module 70 provided. The front end of the rear housing section 20 includes a seal groove 102 as shown in FIG. 5, just behind the external threads 104, to hold and position the housing seal 78. A stop 106 limits the rearward range of travel of the front housing section 16 on the rear housing section 20. A housing ring 18 is pressed onto the rear housing section 20 and positioned adjacent to the stop 106. At the back end of the flashlight 10, threads 98 on the end cap 22 are engaged with rear internal threads 108. An end cap seal or O-ring 92 within a groove 93 on the end cap 22 seals the end cap 22 against a recess 109 in the rear housing section 20. A battery spring 94 grounds the negative terminal of the rear most battery to the rear housing section 20, and forces the batteries 90 into contact with each other and with the battery contact 76. A hole 96 through the end cap 22 allows the flashlight 10 to be mounted on a key chain, key ring or wire.

Figure 13:
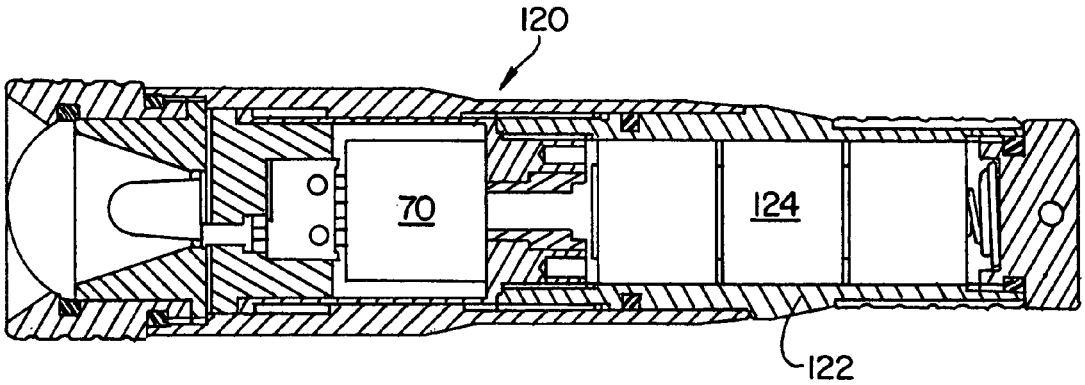
FIG. 13 is a section view of an alternative embodiment.

FIG. 13 shows an alternative embodiment having a shorter length than the flashlight shown in FIGS. 1–5. The shorter length is provided by having a shorter rear housing section 122 and using shorter batteries 124. The flashlight 120 in FIG. 13 is otherwise the same as the flashlight 10 shown in FIGS. 1–5.

The LED 50 is preferably an NSPW510BS, with a 50° directivity angle available from Nichia Corporation, Tokyo, Japan. The directivity angle generally is the included angle of the solid cone of light emanating from the LED. Outside of this solid conical angle, there is little or no light. Within the directivity angle, with most preferred LED's, the light is reasonably uniform, with some decrease in intensity near the sides or boundary of the angle. The directivity angle is specified by the LED manufacturer. Other more powerful LEDs will soon be available, which may affect lens selection. The lens 14 is preferably an aspheric 01LAG001, 2 or 111 (having a focal length of 12 mm) available from Melles Griot, Carlsbad, Calif., USA. A plano/convex lens or other lenses may also be used. The lens preferably has a high level of strength to better resist pressure, such as water pressure when used underwater. In general, the front or outwardly facing surface of the lens will be curved, domed, or convex, as shown in FIG. 4, to better resist pressure forces.

Experimentation with LED's and lenses reveals that, in terms of flashlight performance, a specific relationship exists between the directivity angle A of the LED and the focal length of the lens f (in millimeters). For preferred performance characteristics, the ratio of A/f is within the range of 3.5 to 6.5, preferably 4 to 6 or 4.5 to 5.5, and more preferably approximately 5.

Figure 19:
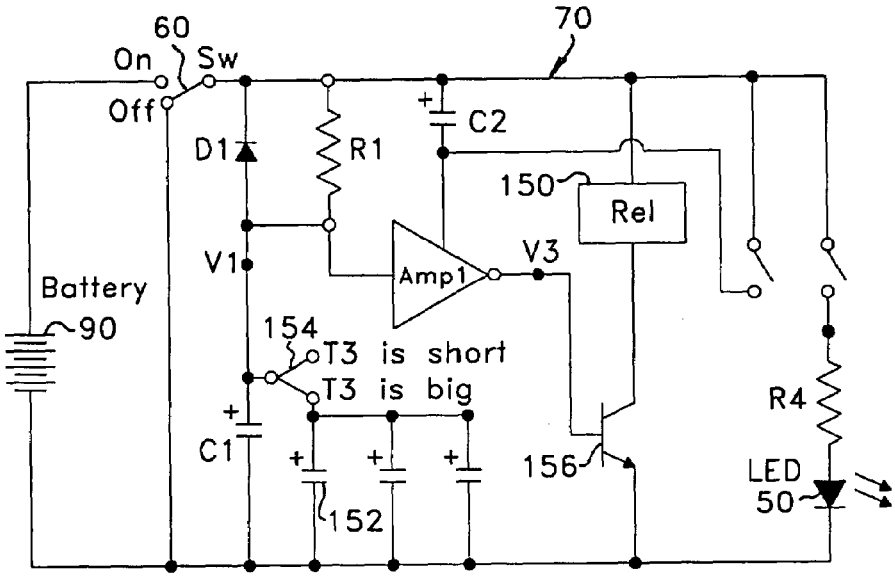
FIG. 19 is a schematic illustration of the shut off timer circuit in the circuitry module shown in FIGS. 3–5.

FIG. 4 shows the flashlight 10 in the off position. The front housing section 16 is threaded onto the rear housing section 20, until it comes to the stop 106. In this position, the plunger 56 is almost entirely within the switch housing 54, causing the switch 60 to be in the off position. Electrical power provided from the batteries 90 through the battery contact 76 and circuitry module 70, as well as through the rear housing section 20, is provided to the switch 60. The switch 60 is also connected to the LED, as shown in FIG. 19. As the switch 60 is in the off position, no power is provided to the LED. To turn the flashlight 10 on, the front housing section 16 is turned (counter clockwise in FIG. 1) causing it to move forward via the interaction of the threads 104 and 84. As the front housing section 16 moves forward, the front cap 12, lens 14 and the lamp housing 42 move with it. The LED 50, switch housing 54, plunger 56, switch 60 circuitry module 70 all remain in place, as they are supported within the switch housing tube 72 which is fixed to the rear housing section 20.

As the LED or light source 50 and lamp housing 42 move away from the switch housing 54, the plunger 56, biased by spring force in the switch 60 also moves forward or outwardly. This movement causes the switch 60 to move into an on position. In the on position, the electrical power is provided to the LED 50. To focus the light from the LED or light source 50, the user continues to turn the front housing section 16. This increases the spacing "S" between the lens 14 and the LED 50, allowing light from the LED to be focused to a desired distance. A position stop 130 on the front end of the switch housing tube 72 prevents the front housing section 16 from separating from the rear housing section 20. When the front housing section 16 is turned to its maximum forward position (where further forward movement is prevented by the stop 130), the lens 14 focuses the light to a maximum distance.

Figure 12:
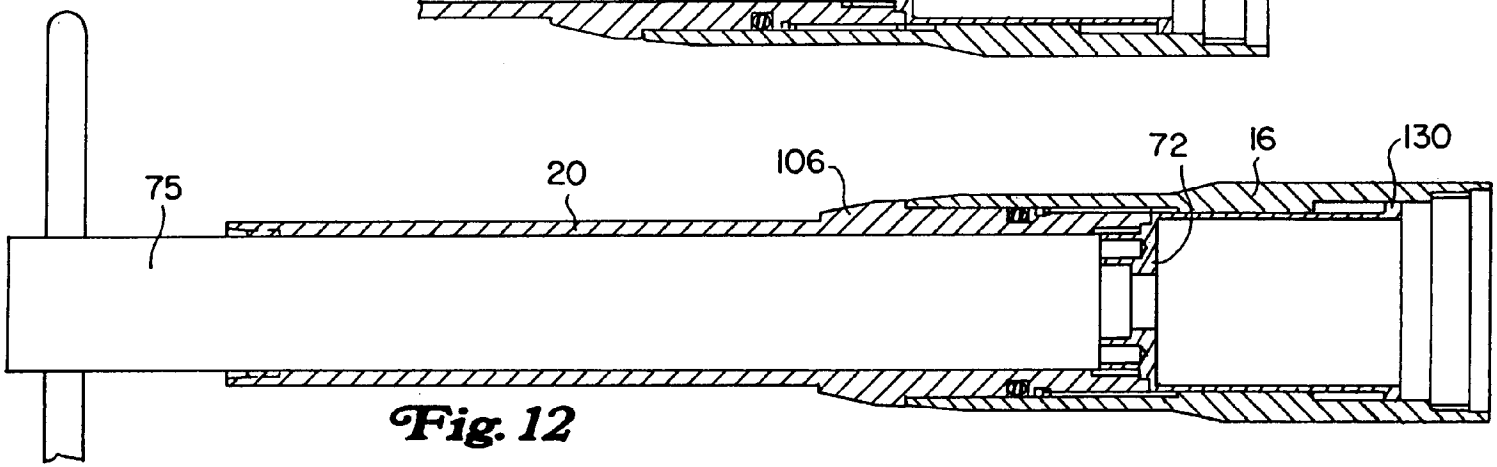
FIG. 12 is a section view showing installation of the switch housing tube.

Referring momentarily to FIG. 12, the switch housing tube 72 is installed from the front end of the front housing section. The threaded section 73 of the switch housing tube 72 engages with the threads 82 on the front housing section. The spanner tool 75 is inserted through the back end and is used to tighten the switch housing tube 72 in place. The rim or stop 130 at the front end of the switch housing tube acts as a mechanical stop to prevent the front housing section from separating from the rear housing section.

The combination of the LED 50 and the lens 14 allows the flashlight 10 to focus, and also to provide a narrow direct beam of light. The focusing range of the lens 14 allows filaments of the light source, which appear in the beam, to be used as pointers or indicators. A light beam provided by the flashlight 10 has minimal dark spots. In addition, the spot pattern produced by the flashlight 10 is nearly a perfect circle, throughout the entire range of focus. The LED or light source 50 may be provided in various colors.

In general, light from the LED is focused by the lens, and no reflector is needed. However, with some LEDs, use of a reflector, in combination with a lens, may be advantageous. If the LED used has a large directivity angle, for example, 60, 70, 80, 90 degrees, or greater, the lamp housing 42 can also act as a reflector. Specifically, the interior curved or conical surface or wall 44 is made highly reflective, e.g., by polishing and plating. The divergence angle of the wall 44, or curvature, is then selected to reflect light towards the lens. While in this embodiment the reflector (formed by the surface 44) moves with the lens, a fixed reflector, e.g., supported on the switch housing 64, may also be used.

The housing ring 18 and front cap 12 provide convenient grip surfaces for turning the front and rear housings relative to each other to switch the flashlight 10 on and off, and to focus the light beam. The housing seal 78 is the only dynamic seal in the flashlight 10. The other seals are static.

Referring to FIG. 19, when the flashlight 10 is turned on by twisting or turning the front and rear housing sections 16 and 20, the switch 60 closes, or moves to the on position. Battery voltage 90 is then applied to the relay 150, causing the relay to close. Consequently, current flows through the LED 50 generating light. At the same time, the capacitor C1 begins to charge. When the voltage V1 across the capacitor C1 reaches a trigger level, it causes the output of the amplifier 158 (which act as an inverter) to cause the transistor 156 to switch the relay off or open. Power to the LED 50 is then interrupted, preserving the life of the battery 90.

To turn the flashlight 10 back on, the switch 60 is returned to the off position by turning the front and rear housing sections in the opposite directions. With the switch 60 in the off position, the capacitor C1 discharges through the resister R1, returning V1 to zero, and effectively resetting the timer 70. When the switch 60 is moved back to the on position, power is again supplied to the LED, and the flashlight is turned on to provide light. The timer circuit 70 reset to turn off power to the LED after a preset interval. The preset interval is determined by selecting the value of C1. By providing one or more additional capacitors 152 and a capacitor switch 154, the time interval before shut off can be adjusted, or selected from two (or more) preset values. The switch 154 is on or in the switch housing 54, is typically set by the user's preference, and then remains in the shorter or longer internal position. The second switch position can be a timer bypass option.

Turning now to FIGS. 14–18, in another flashlight embodiment 200, three lamps or LED's 50 are provided, and a lens 14 is aligned and associated with each LED 50. Except as described below, the flashlight 200 is similar to the flashlight 10 described above. A lens ring 202 and a lens base 204 have three openings 206 for receiving or holding three lenses 14. Each lens 14 is secured in place on the lens ring 202 within an O-ring 208. The lens ring 202 and lens base 204 are attached to each other by screw threads, adhesives, etc., after the lenses 14 are placed into the lens ring 202. Counterbores 209 extend into the back surface of the lens base 204. Anti-rotation pins 210 extend from the switch housing 212 into the counterbores. As the switch housing 212 is fixed to the rear housing section 214, the lens ring 202 does not rotate with the front housing. The lenses 14 in the lens ring can move longitudinally towards and away from the LED's, while staying aligned with the LED's. The switch housing 212 holds three LED's 50, with each LED aligned with a lens 14. A Teflon (Flourine resins) washer 214 between the front housing section 216 and the lens base allows the front housing section 216 to rotate and slide smoothly against the lens base 204, as the front housing section 216 is rotated to turn on or focus the flashlight 200. Similarly, a low friction O-ring or seal 218 supports the lens ring 202 within the front housing section 216, while allowing for rotational and front/back sliding movement between them. A front cap 220 is sealed against the front housing section 216 with an O-ring or seal 222.

In use, as the front housing section 216 is twisted or rotated, it moves front to back via the interaction of the screw threads 104 and 84. The LED's 50 remained fixed in place. The lenses 14 move front to back, with movement of the front housing section, but they do not rotate as the lens ring 202 and lens base 204 are held against rotation or angular movement by the pins 210. Consequently, light from each of the three LED's 50 can be focused with movement of the front housing section 216. Of course, the design shown in FIGS. 14–18 is suitable for use with 2, 3, 4 or any number of additional LED's.

Figure 20:
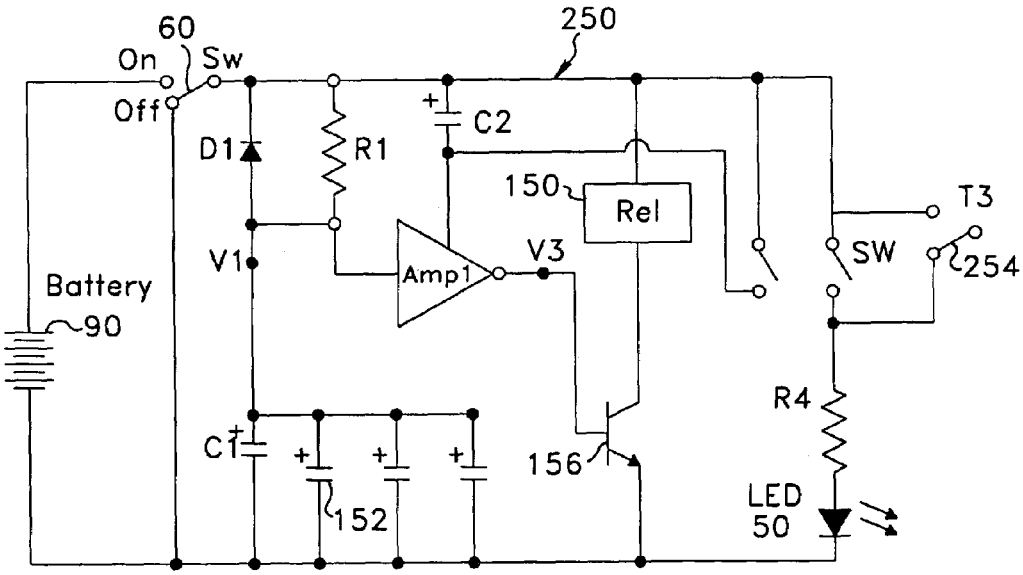
FIG. 20 is a schematic illustration of an alternative shut off timer circuit for use in the circuitry module shown in FIGS. 3–5.

Turning to FIG. 20, in an alternative timer circuit 250, the switch 154 is removed and replaced with switch 254. The switch 254, when closed, connects the LED 50 and the resistor R4 directly to the battery 90. All of the other components are bypassed. As a result, when the switch 254 is closed, the timer circuit 250 is inactive or disabled, and illumination by the LED is controlled purely by the switch 60. This design is advantageous where the user wants the flashlight to remain on until manually turned off using the switch 60, which is actuated by turning the front housing section. When the switch 254 is in the open position, the timer circuit shown in FIG. 20 operates in the same way as the timer circuit 70 shown in FIG. 19. With the switch 254 open, the timer circuit 250 automatically turns the flashlight off after a preset interval of time determined by the capacitors C1 and 152. The timer circuit 250 otherwise operates in same way as the timer circuit 70, except as described above.

Figure 6:
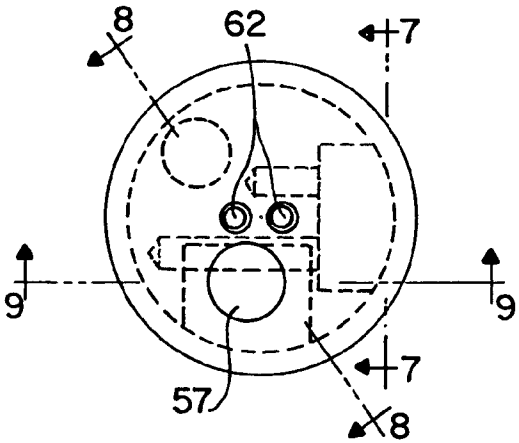
FIG. 6 is a top view of the switch housing shown in FIGS. 3–5.
Figure 9:
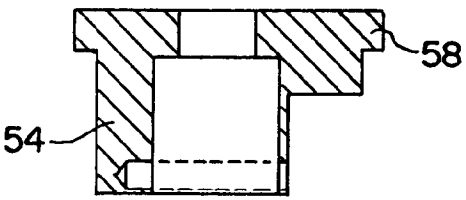
FIG. 9 is a section view taken along line 9—9 of FIG. 6.
Figure 14:
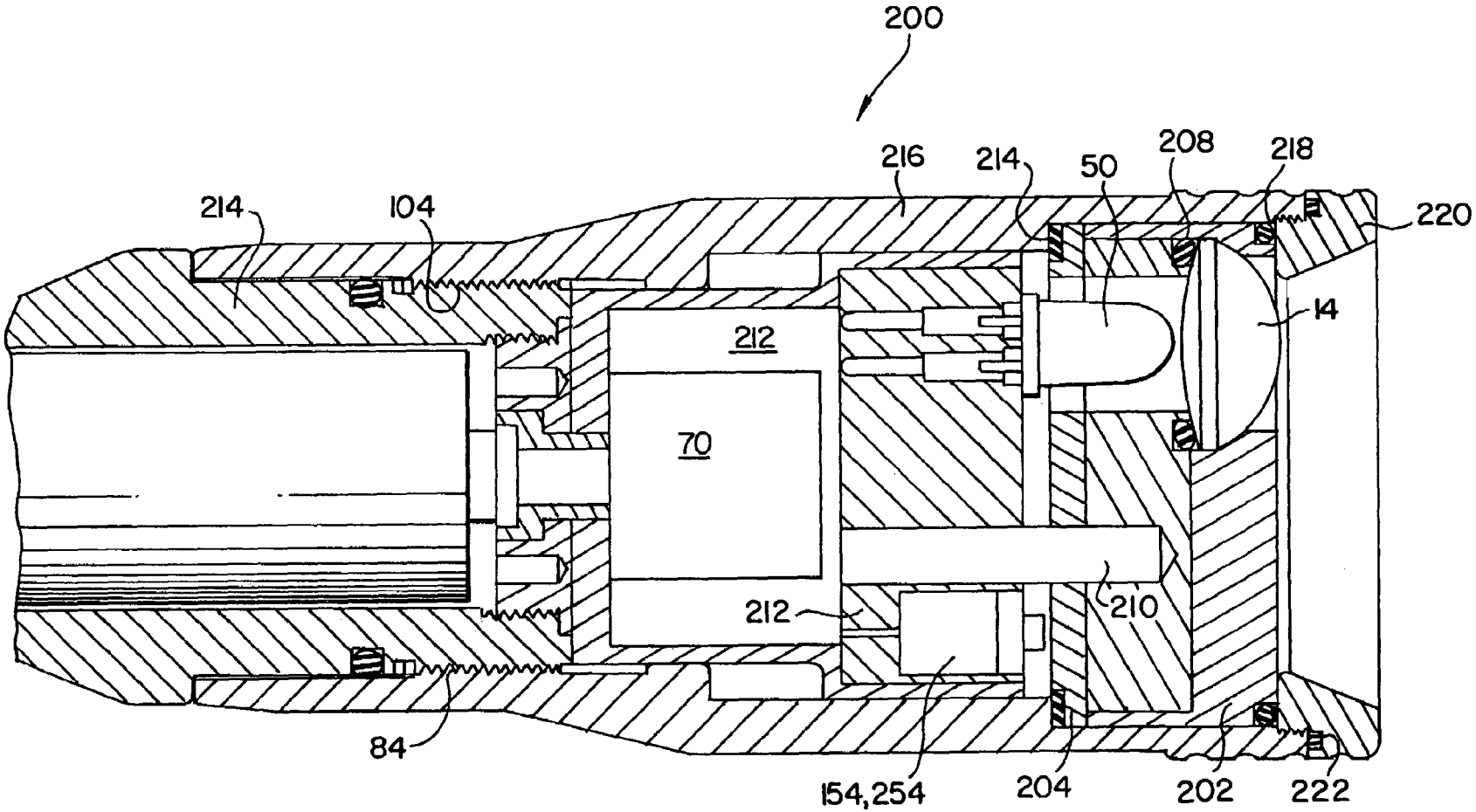
FIG. 14 is a section view of another alternative embodiment.
Figure 15:
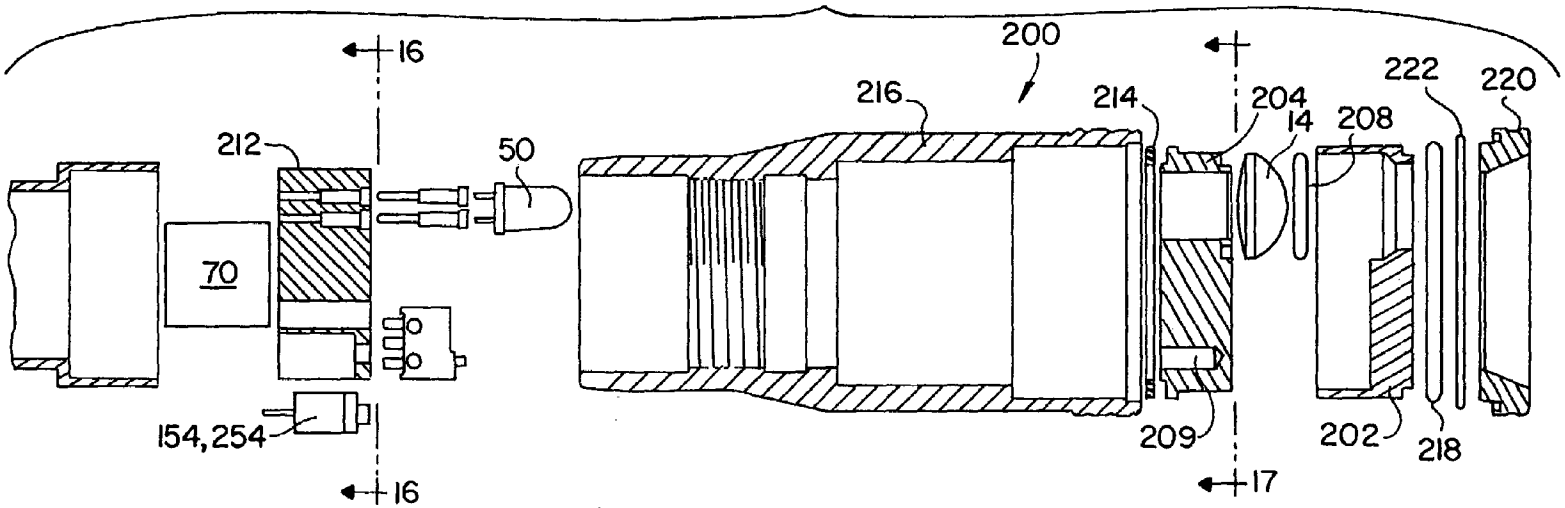
FIG. 15 is an exploded section view of the flashlight shown in FIG. 14.
Figure 18:
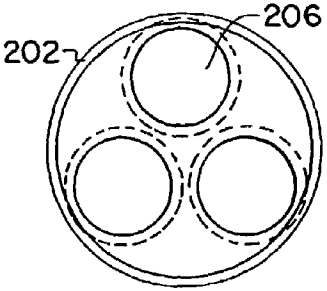
FIG. 18 is an elevation view taken along line 18—18 of FIG. 15.
Figure 17:
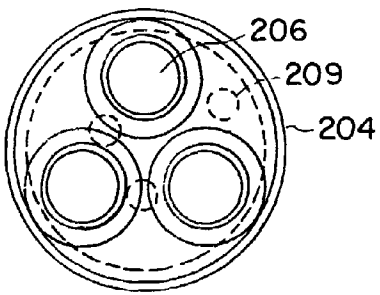
FIG. 17 is an elevation view taken along line 17—17 of FIG. 15.
Figure 16:
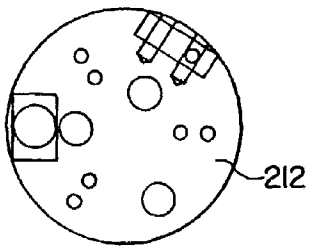
FIG. 16 is an elevation view taken along line 16—16 of FIG. 15.

Referring momentarily to FIGS. 5 and 17, the switch 154 or 254 is set in the open or closed position by removing the front cap 12, along with the lens 14, O-ring 40, and the lamp housing 42 (which remain as a single sub-assembly with the lamp housing pressed into the front cap 12). Referring to FIG. 6, an instrument, such as a small screwdriver blade, or even a pen or pencil tip, is inserted through the access hole 57 in the switch housing 54 to set the switch 154 or 254 to the desired position. The switch 154 can be set to a shorter or a longer time interval before automatic shutoff. If the switch 254 is used, the switch positions are automatic shutoff mode (determined by the capacitors), or "permanent on" where the flashlight acts as a conventional flashlight controlled entirely by the switch 60, and with no automatic shutoff feature. Referring to FIG. 14, in the embodiment 200, the switch 154 or 254 is set by removing the front cap 220, along with the O-rings 208 and 222, the lens ring 202, the lens base 204, and the lenses 14 (which remain as single sub-assembly). The switch 154 or 254 is then readily directly accessible.

Thus, a novel flashlight has been shown and described. Various changes and modifications may be made without departing without the spirit and scope of the invention. The invention, therefore, should not be limited, except by the following claims, and their equivalents.

What is claimed is:

1. A flashlight comprising:

a first housing section;

a second housing section attached to the first housing section with screw threads;

a seal between the first and second housing sections;

a stop engageable against a surface on the first housing section to prevent the first housing section from separating from the second housing section by rotation of the first housing section relative to the second housing section;

a single LED supported on the second housing section;

a lens having a convex front surface, with the lens axially aligned with the LED and supported directly or indirectly on the first housing section adjacent to the LED, and with the lens and the first housing section longitudinally moveable relative to the LED, to a position where the spacing S between the LED and the lens is less than the maximum thickness of the lens, to focus light from the LED; and the LED having a directivity half angle A, and the lens having a focal length f, and with the ratio of A/f between 3.5 degrees/mm and 6.5 degrees/mm.

2. The flashlight of claim 1 further comprising a lens base on the front housing section with the lens aligned with the LED, and with the lens base axially moveable with rotation of the front housing, while maintaining the lens in alignment with the LED.

3. The flashlight of claim 1 where the lens has a spherical front surface.

4. The flashlight of claim 1 further comprising a reflector adjacent to the LED, and with the LED between the reflector and the lens.

5. The flashlight of claim 1 further comprising a front cap attached to a front end of the front housing section, with the lens secured within the front cap; a first seal between the lens and front cap, and a second seal between the front cap and the front housing section.

6. The flashlight of claim 1 with the lens having a focal length of 8–16 mm.

7. The flashlight of claim 1 wherein the stop comprises an annular rim.

* * * * *